United States Patent [19]

Negishi

[11] Patent Number: 4,561,564

[45] Date of Patent: Dec. 31, 1985

[54] ARTICLE DISPENSING MECHANISM FOR A VENDING MACHINE OR THE LIKE

[75] Inventor: Hideo Negishi, Isesaki, Japan

[73] Assignee: Sanden Corporation, Isesaki, Japan

[21] Appl. No.: 643,685

[22] Filed: Aug. 23, 1984

[51] Int. Cl.[4] ..... B65D 83/00

[52] U.S. Cl. ..... 221/64; 221/67; 312/45

[58] Field of Search ..... 221/67, 242, 295, 298, 221/299, 64; 193/27, 32, 7; 211/162, 59.2; 312/45, 72, 73, 42, 49

[56] References Cited

U.S. PATENT DOCUMENTS

| | | | |
|---|---|---|---|
| 1,736,057 | 11/1929 | Smith | 221/67 X |
| 1,981,272 | 11/1934 | Kuhn et al. | 193/27 X |
| 3,924,779 | 12/1975 | Lindsey | 221/242 X |
| 4,456,147 | 6/1984 | Tominaga | 221/67 |

*Primary Examiner*—Joseph J. Rolla
*Assistant Examiner*—David H. Bollinger
*Attorney, Agent, or Firm*—Banner, Birch, McKie & Beckett

[57] ABSTRACT

An article dispensing mechanism for a vending machine includes at least one serpentine track comprising a pair of facing serially cusp-shaped vertical panels. These panels are attached to side plates of the machine and connected to one another by biasing springs in such a manner as to provide yielding horizontal mobility between opposed panels. This horizontal movement of the vertical panels absorbs the usual article impact which occurs during article loading and dispensing. Also, the article discharge control device is mounted to be vertically movable and biased upwardly to absorb impact shocks from the articles incident article dispensing.

4 Claims, 4 Drawing Figures

ARTICLE DISPENSING MECHANISM FOR A VENDING MACHINE OR THE LIKE

TECHNICAL FIELD

This invention relates to an article dispensing mechanism for a vending machine, and more particularly, to a serpentine type article dispensing mechanism for the dispensing of cylindrical articles.

BACKGROUND OF THE INVENTION

It is generally known in the art of single or double depth serpentine track dispensing mechanisms for cylindrical articles that storage capacity is increased by utilizing the serpentine type track without increasing the outer configuration of the article storage area. As shown in U.S. Pat. Nos. 3,498,497 and 3,613,945, each serpentine track has a meandering shape from top to bottom which causes cylindrical articles to roll down from the upper end thereof to a discharge opening at the lower end thereof in response to gravity. Delivery of these cylindrical articles from the discharge opening is controlled by a discharge control device disposed at the discharge opening.

In serpentine track dispensing mechanisms of the above type, if glass bottles are loaded into the storage area, these glass bottles may break with resultant injury or damage to the user and/or the vending machine itself. Glass bottles may break during loading into the storage area or during the dispensing/discharging operation when these bottles strike against parts of the dispensing mechanism or come in contact with the discharge control device.

SUMMARY OF THE INVENTION

It is a primary object of this invention to provide an improved article dispensing mechanism for vending machines that utilizes a serpentine track which can absorb article impact.

It is another object of this invention to provide an article dispensing mechanism for vending machines which is simple in construction and easy to assemble.

An article dispensing mechanism for vending machines according to this invention includes a pair of side plates which face each other to define a pre-determined gap therebetween forming a storage area for articles. One or more pairs of serially cusp-shaped vertical panels are supported between two side plates to form one or more serpentine tracks, each of which includes an upper end opening for loading and a lower end opening connected with a discharging space. Each vertical panel is supported between both side plates of the dispenser storage area by a plurality of supporting members which are mounted to enable horizontal movement of the panels. Each supporting member is attached at both sides of the dispensing mechanism to a connecting plate. Two adjacent connecting plates on each side of the mechanism are engaged by a plurality of coil springs whereby the plates and panels carried thereby by means of the supporting members are drawn toward each other. The impact of the articles moving down the serpentine track defined between a pair of the facing vertical panels is absorbed due to the yielding horizontal movement of the vertical panels.

Further objects, features and other aspects of this invention will be understood from the following detailed description of a preferred embodiment of this invention referring to annexed drawings.

DETAILED DESCRIPTION OF THE PREFERRED EMBODIMENT

Figure 1:
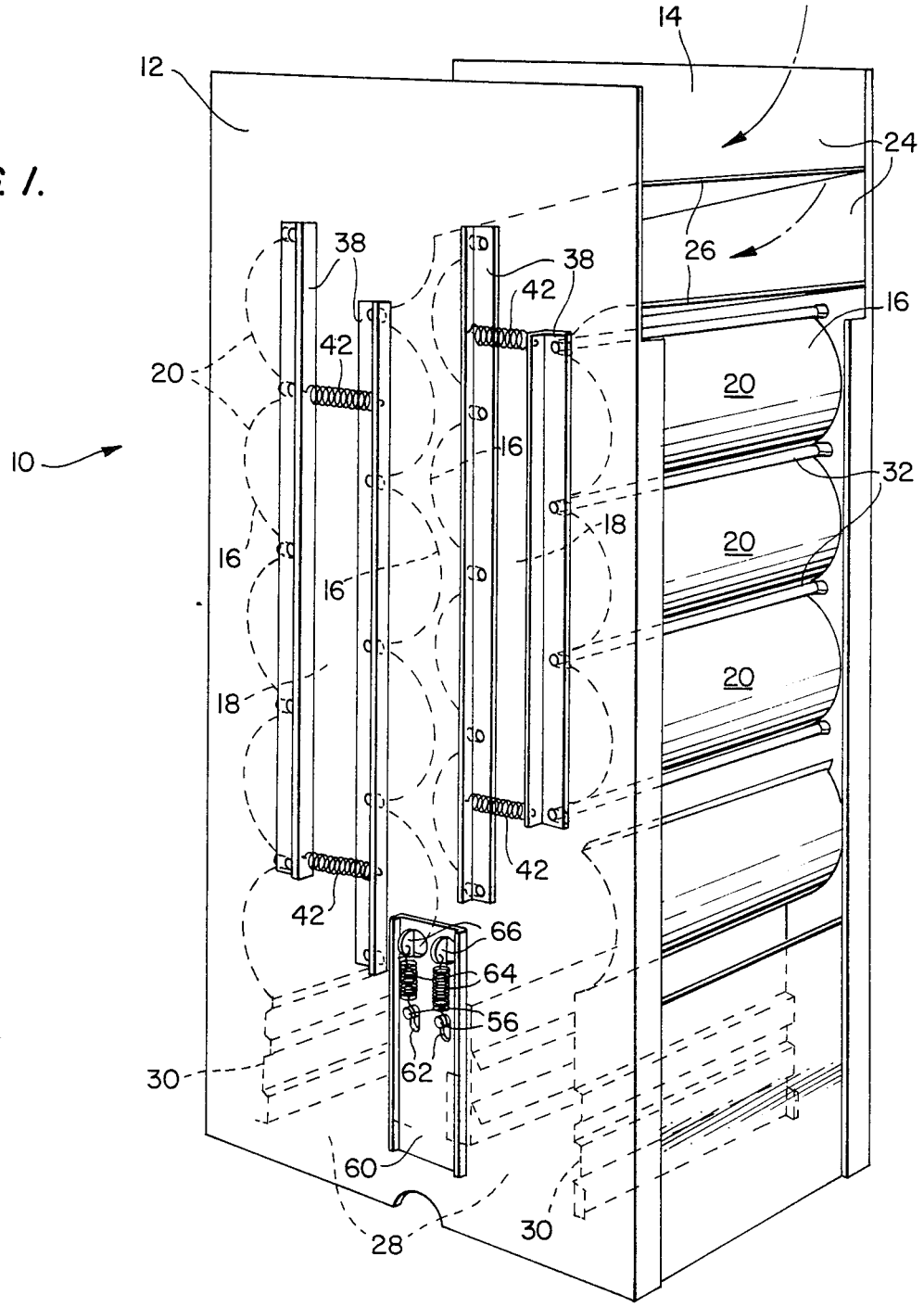
FIG. 1 is a perspective view of an article storage area of a vending machine according to the invention having two serpentine tracks for the dispensing mechanism.

Referring to FIG. 1, article storage device 10 includes a pair of side plates 12 and 14 and a plurality of serially cusp-shaped vertical panels 16 which define between each pair of facing panels 16 a serpentine track 18. Side plates 12 and 14 are suitably connected together to be parallel to each other to define therebetween a predetermined gap forming spaces for article loading and discharging. This gap will of course be adequate to accommodate the length of the cylindrical articles which are to be stored in and dispensed from the dispensing mechanism storage area.

Serially cusp-shaped vertical panels 16 are supported transversely between side plates 12 and 14. As best seen from FIGS. 1, 3 and 4, each vertical panel 16 has a plurality of semicircular cusp-shaped portions 20 in series. Each serpentine track 18 is formed by a pair of the facing vertical panels 16 with the semicircular shaped cusp portions 20 alternating with one another, i.e., connecting portions 22 interconnecting semicircular shaped cusp portions 20 on one panel 16 are not aligned with the corresponding portion 22 on the opposed panel 16. The width of the space defining each track 18 as measured in any horizontal plane along the length of the track is preferably slightly greater than the diameter of the maximum size article it is contemplated the dispensing mechanism will be called upon to handle. Of course it is intended that the mechanism will handle several different diameter articles.

The upper portion of each serpentine track 18 communicates with its own article loading space 24 by way of guide plates 26. The lower portion of each serpentine track 18 is connected to its own article discharging space 28 formed by guide plates 30.

Figure 3:
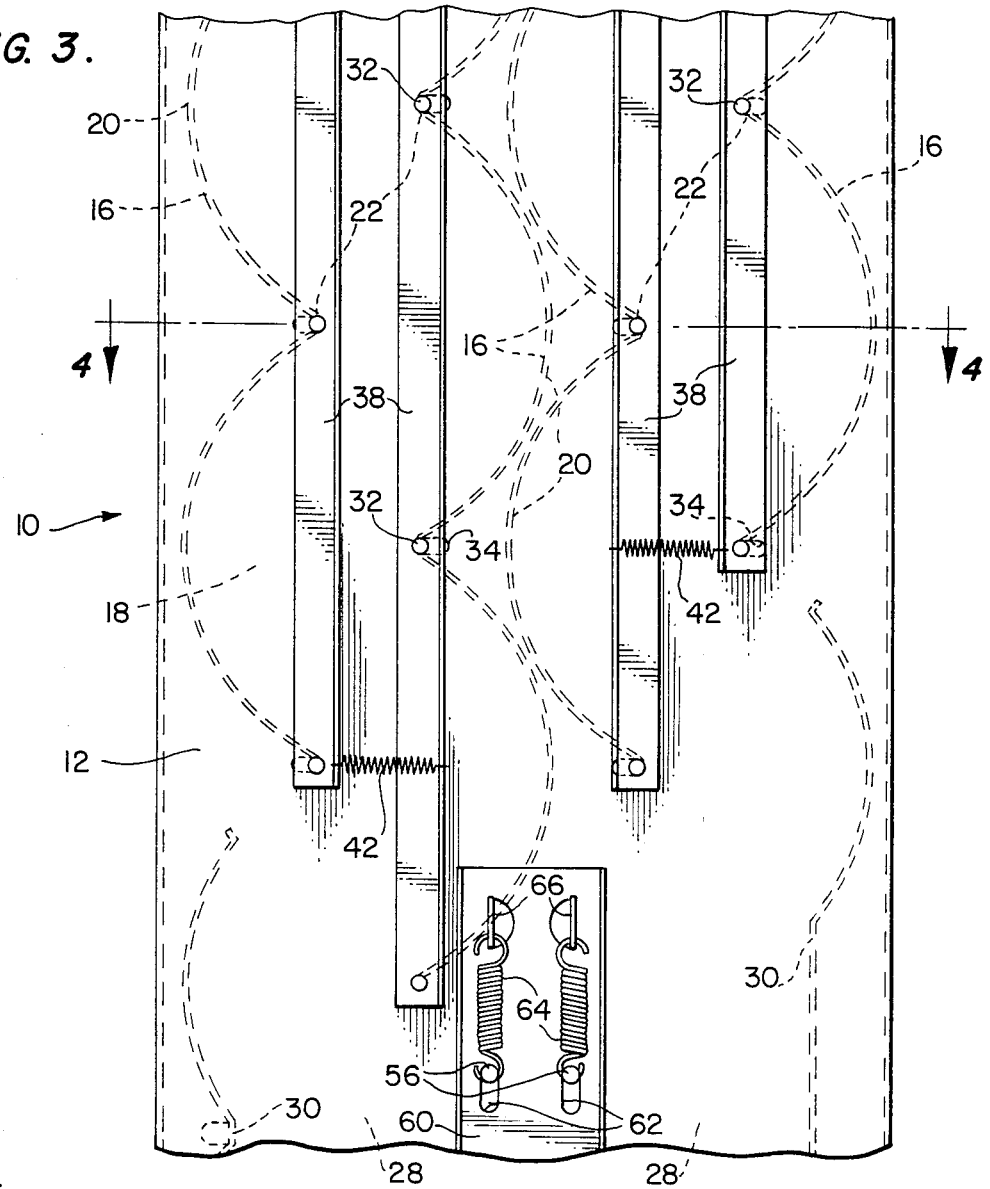
FIG. 3 is a enlarged partial side elevational view of FIG. 1 illustrating details of the attachment between a side plate and the vertical panels.
Figure 4:
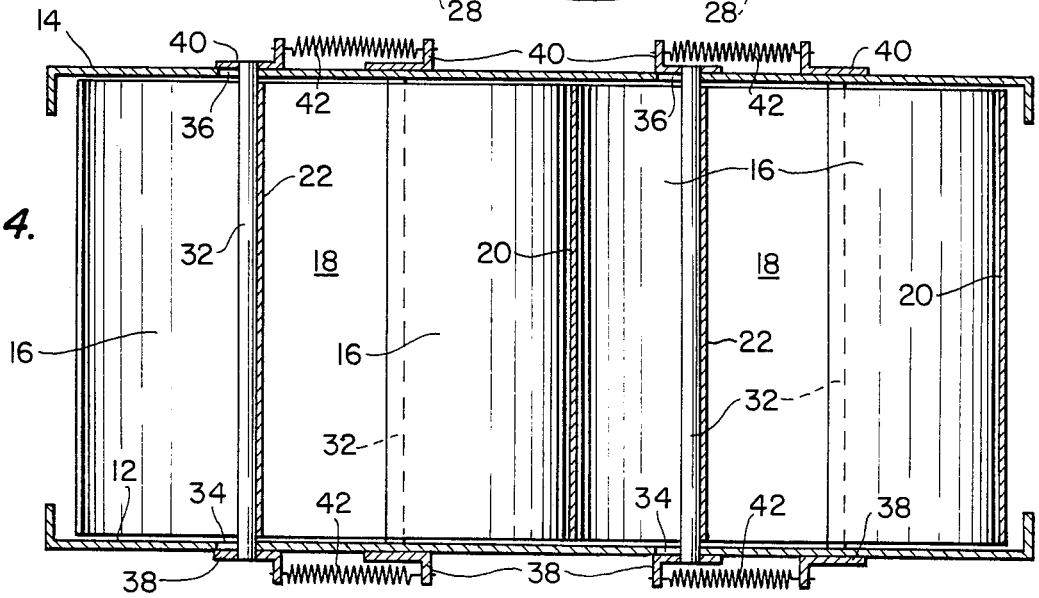
FIG. 4 is a cross-sectional view taken on line 4—4 of FIG. 3.

As shown in FIGS. 3 and 4, each vertical panel 16 is supported between both side plates 12 and 14 by a plurality of support members 32. One support member 32 extends horizontally along each of the connecting portions 22 of each vertical panel 16. The ends of support members 32 are positioned in horizontal slots 34 and 36. As best seen in FIG. 4, the slots 34 and 36 are formed in side plates 12 and 14, respectively, so as to enable limited horizontal movement of support members 32. The vertical panels 16, supported by support members 32 similarly move horizontally due to movement of the support members 32 within slots 34 and 36. Each support member 32, extending between the side plates 12 and 14, has its outer ends affixed to two connecting plates 38 and 40 positioned on opposite outer sides of the side plates 12 and 14, respectively. Each of the two adjacent connecting plates 38 on side plate 12 and adjacent connecting plates 40 on side plate 14 are engaged by a plurality of coil springs 42 whereby these adjacent connecting plates are drawn toward each other.

As illustrated and described in this embodiment, the vertical panels 16 each consist of one unitary element. Alternatively, the serpentine track may be formed by a plurality of individual cusp-shaped portions.

Figure 2:
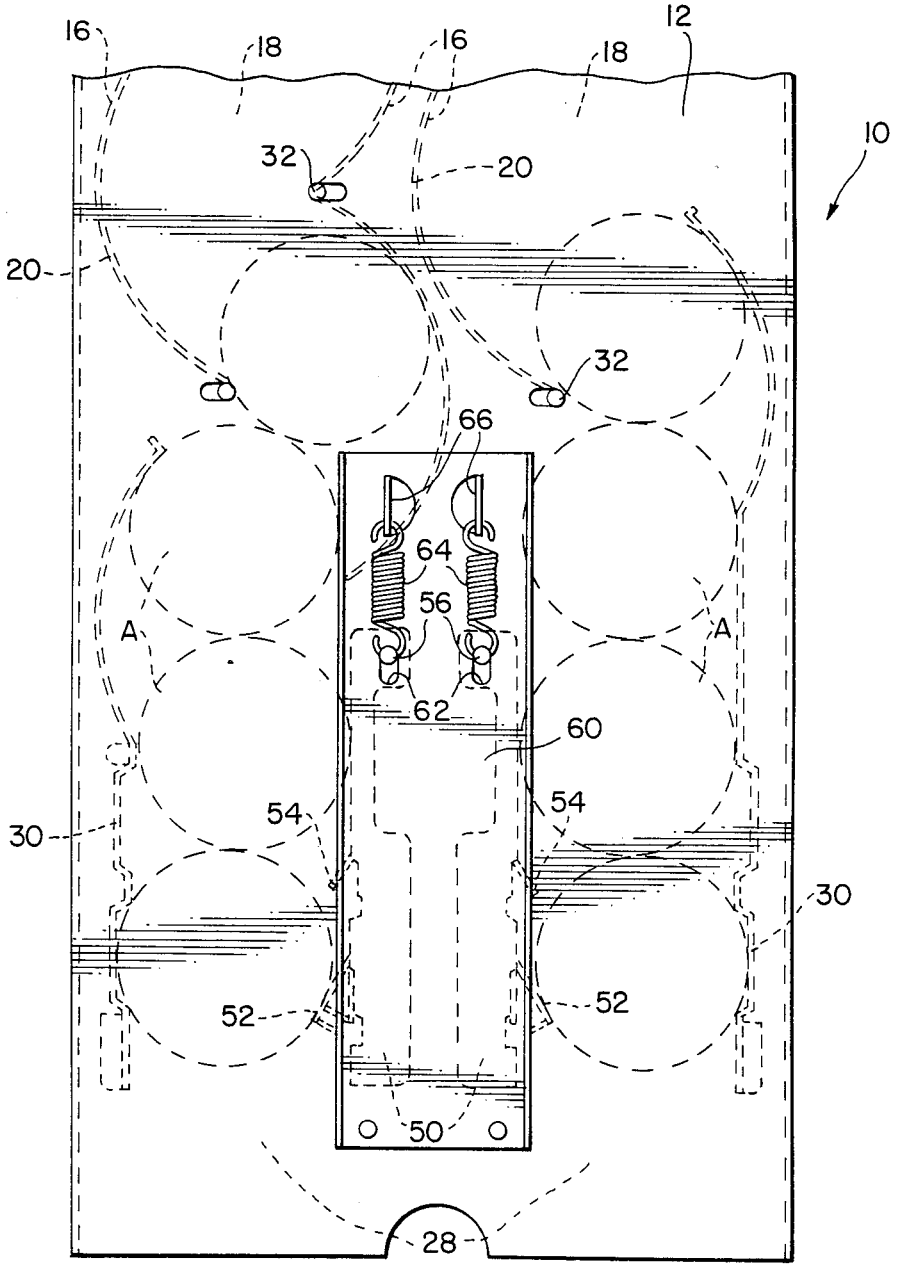
FIG. 2 is an enlarged partial side elevational view of FIG. 1 illustrating a discharge control device at the lower end of the dispensing mechanism.

As shown in FIG. 2, the discharging space 28 from each track 18 of article storage device 10 includes a discharge control device 50 which has a gate lever 52 and stop lever 54 to control the dispensing and holding, respectively, of articles A. This device 50 may be comparable to that shown in U.S. Pat. No. 3,348,733. Each control device 50 is attached to extend between side plates 12 and 14 by supporting pins 56 projecting from the upper side surfaces of device 50. The ends of pins 56 are received in vertical slots formed in side plates 12 and 14 to enable limited vertical movement of control device 50. A fixed plate 60 is mounted on the exterior of each side plate 12 and 14. Plate 60 is provided with slots 62 to correspond with slots of the side plates 12 and 14. The ends of the pins 56 protruding through corresponding slots in side plates 12 and 14, and slots 62 in plates 60 are attached to the lower end of coil springs 64. The upper end of each coil spring 64 is hooked through a tab 66 bent out from fixed plate 60. Each discharge control device 50 as thus supported on side plates 12 and 14, is vertically movable against the upward biasing force of coil springs 64.

In summary of the detailed description, a plurality of pairs of opposed serially cusp-shaped vertical panels supported by side plates form the serpentine tracks. The two members of each pair are yieldingly interengaged with each other by coiled tension springs to provide horizontal mobility and thus to absorb the usual article impact against the panels during the loading or discharging of articles. The serpentine configuration of the tracks is constantly maintained by the tension biasing of the coil springs during periods of horizontal movement. The invention also features a discharge control device, supported by the dispenser mechanism side plates, which has vertical yieldable mobility to absorb the usual impact caused by the articles during the dispensing discharging operation and thus prevent damage from occuring to the articles.

Examples of a preferred embodiment of this invention have been described in detail, but the invention is not to be considered as restricted thereto. It will be easily understood by those skilled in the art that many other variations and modifications can be made all within the scope of this invention as claimed.

I claim:

1. In an article dispensing mechanism for a vending machine including a pair of side plates facing one another at a predetermined spacing and at least one pair of serially cusp-shaped vertical panels disposed transversely between said side plates, said panels facing each other to define a serpentine track, an upper open end of said serpentine track being connected to an article loading space and a lower open end of said serpentine track being connected to an article discharge space, and a discharge control device associated with said discharge space to control the dispensing articles, the improvement comprising at least one of said panels being mounted on said side plates to be horizontally movable by a plurality of supporting members projecting from the movably mounted panel, each said supporting member extending into a slot in a side plate, a plurality of said supporting members being connected by means of a first connecting plate, a plurality of said supporting members being connected by means of a second connecting plate adjacent said first connecting plate and biasing means connecting said adjacent connecting plates such that they are drawn toward each other.

2. The article dispensing mechanism for a vending machine of claim 1 wherein each said side plate has a plurality of slots into which a plurality of said supporting members extend providing a gap in each slot to enable movement of said supporting members within said slots.

3. The article dispensing mechanism for a vending machine of claim 1 wherein said discharge control device is vertically movable and supported by said side plates.

4. The article dispensing mechanism for a vending machine of claim 3 wherein supporting pins protrude from opposite sides of said control device, said pins extending into vertical slots in said side plates, and each said supporting pin being engaged by biasing means.

* * * * *